US012169076B2

(12) United States Patent
Garrabrant et al.

(10) Patent No.: US 12,169,076 B2
(45) Date of Patent: Dec. 17, 2024

(54) HYDRONIC AIR-HANDLER DEVICES AND SYSTEMS

(71) Applicant: Stone Mountain Technologies, Inc., Johnson City, TN (US)

(72) Inventors: Michael A. Garrabrant, Unicoi, TN (US); Matthew C. Blaylock, Gray, TN (US); David M. Firestine, Gray, TN (US); Joseph A. Newland, Limestone, TN (US); Adam T. Roberts, Unicoi, TN (US)

(73) Assignee: Stone Mountain Technologies, Inc., Johnson City, TN (US)

( * ) Notice: Subject to any disclaimer, the term of this patent is extended or adjusted under 35 U.S.C. 154(b) by 0 days.

(21) Appl. No.: 18/157,193

(22) Filed: Jan. 20, 2023

(65) Prior Publication Data

US 2023/0243545 A1 Aug. 3, 2023

Related U.S. Application Data

(60) Provisional application No. 63/304,180, filed on Jan. 28, 2022.

(51) Int. Cl.

| | |
|---|---|
| ***F24F 11/84*** | (2018.01) |
| ***F24F 3/044*** | (2006.01) |
| ***F24F 5/00*** | (2006.01) |

(52) U.S. Cl.

CPC ..... *F24F 11/84* (2018.01); *F24F 3/044* (2013.01); *F24F 5/0003* (2013.01)

(58) Field of Classification Search

CPC ..... F24F 11/84; F24F 3/044; F24F 5/0003; F24D 3/1008

USPC ..... 165/286

See application file for complete search history.

(56) References Cited

U.S. PATENT DOCUMENTS 4,226,364 A * 10/1980 Utesch ..... F24F 5/0003 237/63

2014/0048244 A1* 2/2014 Wallace ..... F24F 11/0008 165/253

* cited by examiner

*Primary Examiner* — Steve S Tanenbaum

(74) *Attorney, Agent, or Firm* — DLA Piper LLP (US)

(57) ABSTRACT

A device that heats/cools air includes a heat exchanger that contains hydronic fluid; a blower that moves air over and/or through the heat exchanger; a pump that circulates the hydronic fluid; a first vessel that contains hydronic fluid under pressure, air, a sealed first opening, a second opening that allows the hydronic fluid to exit the first vessel, a third opening that allows the hydronic fluid to enter the vessel, and a fourth opening; a second vessel that contains hydronic fluid at atmospheric pressure, a sealed first opening, and a second opening in communication with the first vessel, wherein the second vessel is in communication with the fourth opening; a valve that allows hydronic fluid to flow from the second vessel to the first vessel when pressure inside the first vessel decreases below zero psig, and prevents hydronic fluid from flowing from the first vessel to the second vessel.

8 Claims, 2 Drawing Sheets

HYDRONIC AIR-HANDLER DEVICES AND SYSTEMS

TECHNICAL FIELD

This disclosure relates to hydronic air-handler devices and systems including such devices.

BACKGROUND

Heating systems for buildings generally fall into one of two general categories, hydronic or forced air. In hydronic heating systems, a warm or hot liquid (normally water or water-glycol mixtures generally referred to as hydronic liquid or hydronic fluid) is circulated through pipes inside the building to heat emitters. Typical heat emitters include radiators, baseboard radiators or under-floor piping loops. In forced air systems, warmed air is forced through ducts to different parts of the building by a blower. The air is normally heated by a heat exchanger heated by the combustion of natural gas, propane or fuel-oil (typically referred to as a furnace), the condensation of a refrigerant (typically from a vapor-compression cycle heat pump), or a hydronic loop (typically from a boiler or heat pump that transfers heat to the building indirectly via a hydronic loop instead of directly condensing a refrigerant in the indoor heat exchanger).

In forced air heating systems, the device that contains the blower and heat exchanger is called an air-handler unit (AHU). If the AHU is a furnace, it contains the combustion system which directs hot flue gas through a heat exchanger which warms the indoor air flowing over the heat exchanger from the blower. If the AHU is connected to a vapor compression electric heat pump (EHP) as the heating or cooling source, pipes containing the refrigerant directs the refrigerant through the heat exchanger where the refrigerant is either evaporated or condensed by the air flowing over the heat exchanger from the blower. For both of those applications of AHUs, installation is fairly straightforward and simple.

For an AHU containing a heat exchanger heated by a hydronic loop, installation is often more complex due to the need for several extra components and functions required for the hydronic loop to operate correctly and reliably. These components include, but are not limited to, a pump, air-bleed, filter, expansion tank, charging manifold, and a make-up device to replace lost hydronic fluid and/or replace the volume created from entrained air escaping the hydronic loop through the air-bleed. If the hydronic loop contains a water-glycol mixture (typical when freeze protection is required), the make-up device normally consists of a tank filled with water-glycol mixture, a small pump, and a pressure sensor connected to the hydronic loop that causes the pump to activate if the pressure is below a threshold. Hydronic loop make-up devices for water-glycol systems are often large, expensive, and it is often difficult to find a suitable location to install.

Historically, hydronic AHUs are a part of a larger heating system, where the hydronic loop is heated by a boiler, and the larger system consists of a mix of heating emitters including radiators, under-floor piping loops, AHUs, and indirect storage tanks (for heating domestic hot water). Hence, the cost and installation labor for the extra hydronic loop components is absorbed as part of the larger heating system, and not directly by the hydronic AHU.

However, the extra components, especially the labor cost to specify and install, create an economic penalty on forced-air only heating systems using a "hydronic AHU" in place of a standard gas furnace or standard EHP. Installation contractors familiar with conventional forced-air heating and cooling systems are often not familiar with how to specify, install and use the extra hydronic loop components, or have the proper tools and experience to properly fill the hydronic loop using the charging manifold, and bleed out all of the air. That type of hydronic forced-air heating or cooling system may be desired when using a heat pump that uses a flammable or toxic refrigerant that must remain outside the building, or an internal combustion engine or fuel cell electric generator configured to deliver its waste heat to a building using a hydronic loop.

Therefore, it is desirable to have a hydronic AHU where the extra hydronic loop components or equivalent functions are fully integrated into the AHU so that the installer does not have to specify and install separately, or have special tools and skills to properly fill the hydronic loop, bleed out all of the air, and provide maintenance. Also, known hydronic AHU designs do not address the water-glycol make-up system or the difficulty and labor expense involved in properly filling the hydronic loop and bleeding the air.

SUMMARY

We provide a device that heats or cools air including a heat exchanger that includes a hot or cold hydronic fluid; a blower that moves air over and/or through the heat exchanger; a pump that circulates the hot or cold hydronic fluid; a first vessel that contains a first hydronic fluid under pressure, air in a space above the first hydronic fluid, a first opening sealed by a removable lid, a second opening that allows the first hydronic fluid to exit the first vessel, a third opening that allows the first hydronic fluid to enter the vessel, and a fourth opening; a second vessel that contains a second hydronic fluid substantially at atmospheric pressure, a first opening sealed by a removable lid, and a second opening in communication with the first vessel via a first connecting line, wherein the second vessel is in communication with the fourth opening via a second connecting line, a valve that allows the second hydronic fluid to flow from the second vessel to the first vessel when pressure inside the first vessel decreases below zero psig, and prevents the first hydronic fluid from flowing from the first vessel to the second vessel.

We also provide an air-handling unit (AHU) configured to be part of a forced-air heating or cooling system wherein a hydronic loop is used to transfer energy to or from a heating or cooling device to the AHU. The AHU may comprise:

- a blower configured to move indoor air from the building space, across and/or through a hydronic heat exchanger, wherein the air is heated or cooled, and moved back to the building space;
- a hydronic heat exchanger wherein heating or cooling is transferred from a hydronic loop to the indoor air passing over and/or through it, and the heat exchanger may be located either upstream or downstream of the blower;
- a pump that moves the hydronic fluid through the hydronic loop, pulling hydronic fluid out of a pressurized tank;
- a pressurized and sealed tank that contains a volume of hydronic fluid and a volume of air above the hydronic fluid to provide an expansion volume, an inlet opening that allows hydronic fluid to enter from the hydronic loop, an outlet opening that allows hydronic fluid to exit to the hydronic loop, a removable lid that allows the pressurized tank to be filled with hydronic fluid, an optional filter that collects small debris present in the hydronic loop connected to either the hydronic inlet or outlet opening, and an optional sensor or switch that detects the amount of hydronic fluid inside the tank;

a non-pressurized tank that contains a volume of hydronic fluid and a removable lid that allows the non-pressurized tank to be filled with hydronic fluid;

a tube or pipe that connects the pressurized tank and the non-pressurized tank;

a valve located at the inlet, outlet or point in-between of the tube or pipe that connects the pressurized tank and non-pressurized tank configured so that if the pressure in the pressurized tank falls below about zero psig, the valve opens and allows hydronic fluid to flow from the non-pressurized tank to the pressurized tank until the pressure in the two tanks is equalized, wherein the valve is configured so that hydronic fluid cannot move from the pressurized tank to the non-pressurized tank; and optionally, a control valve that can be configured to direct the hot or cold hydronic fluid to either the AHU heat exchanger or another hydronic heating or cooling device such as an indirect storage tank for domestic hot water, conventional radiators or under-floor piping loops, or additional hydronic AHUs.

Our structure provides several advantages. First, all of the required hydronic loop devices or functions are contained within the AHU, which can be fully installed and quality checked at an assembly factory, reducing the labor cost for an installer to specify, source, and install the components. Second, the structure provides for a fast and easy method of filling the hydronic loop and bleeding the air, without the requirement of special tools or skills. Third, the structure provides a volume of make-up hydronic fluid that can be used keep the hydronic loop full due to small leaks or the slow elimination of air, eliminating the need for a separate and expensive water-glycol make-up device. Fourth, the structure allows for provision of an integrated control valve that can direct the heated or cooled hydronic fluid to other hydronic heating or cooling devices.

The pressurized tank provides multiple functions. First, it provides a convenient way of filling the hydronic loop with fluid during installation or system maintenance. To do so, the removable lid is removed so that the hydronic fluid can be poured into the top of the tank. After the tank is full and the lid remains off, the pump is energized, the pump pulls hydronic fluid out of the tank and into the hydronic loop. As the loop is filled, air in the loop can be forced through the hydronic loop and back into the pressurized tank, where the air bubbles rise up through the hydronic fluid in the tank and out through the opening created by removal of the lid. As the pump pulls hydronic fluid out of the tank, the liquid level in the tank drops, allowing additional hydronic fluid to be added to the tank. After all of the air in the hydronic has been forced out, the loop may be completely full of liquid and the level in the tank stabilizes. At that point, the lid containing a seal to allow the tank to be pressurized, is replaced.

Second, the pressurized tank acts as a convenient location for an optional filter that collects small particles and debris in the hydronic fluid, providing protection and increasing longevity of pumps and valves. The filter can be located inside the pressurized tank at either the hydronic inlet or outlet, and removed for cleaning or service through the removable lid.

Third, the pressurized tank acts as the expansion tank for the hydronic loop, ensuring the loop pressure does not increase too high or decrease below about zero psig. After the loop is completely filled with hydronic fluid and the lid replaced, the installer can ensure that the liquid level in the tank is at the full mark. The full mark is below the top of the tank, providing for a volume to air to be trapped at the top of the tank. When the heating device is activated and the hydronic loop temperature increases, the hydronic fluid density decreases which tends to cause the hydronic liquid to take up a larger volume that would normally increase the pressure of a closed loop. However, the air pocket at the top of the tank allows for the hydronic liquid to expand with a small increase in the hydronic loop pressure. The volume of air required to be trapped in the top of the tank to maintain a safe loop pressure is a function of the total volume of the hydronic loop. The preferred maximum hydronic loop pressure is 50 psig.

Fourth, the pressurized tank acts as a location for an optional hydronic fluid level sensor or switch. The sensor or switch detects the liquid level inside the tank and can be used by a control system to provide a warning that hydronic fluid should be added to the tank, or prevent the AHU from operating until fluid is added. This protects the pump from running dry and increases reliability of the AHU.

The non-pressurized tank provides a volume of hydronic fluid available for make-up if necessary, either due to a small leak in the hydronic loop, if additional air bleeds out of the hydronic loop (which collects at the top of the pressurized tank if the pressurized tank lid is sealed), or the system is in cooling mode and the hydronic loop pressure decreases due to the increase in density of the hydronic fluid. The non-pressurized tank is connected to the pressurized tank by a tube or pipe. A valve, installed either at the inlet, outlet or location in-between of the tube or pipe, is configured to allow hydronic fluid to move from the non-pressurized tank to the pressurized tank if the pressure in the pressurized tank falls below about zero psi, thereby automatically providing make-up fluid to the hydronic loop. The valve is also configured to prevent hydronic fluid moving from the pressurized tank to the non-pressurized tank.

Optionally, the AHU can include a control valve that allows for the heated or cooled hydronic fluid to be routed to the hydronic heat exchanger in the AHU, or to another hydronic heating or cooling device such as an indirect storage tank for heating domestic hot water, radiators, under-floor piping system, or one or more additional AHUs.

The AHU is especially useful when connected to a high efficiency heating or cooling source such as an air-to-water, or water-to-water heat pump.

DETAILED DESCRIPTION

Figure 1:
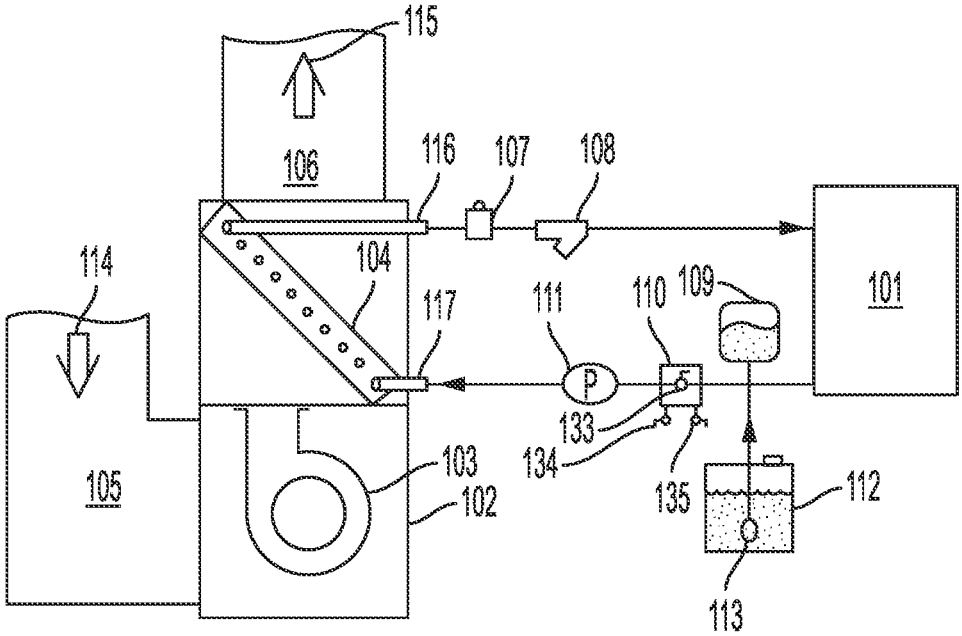
FIG. 1 schematically depicts a typical forced-air heating or cooling system using a hydronic loop and hydronic air-handler.

It will be appreciated that the following description is intended to refer to specific examples of structure selected for illustration in the drawings and is not intended to define or limit this disclosure.

Referring to the drawings, FIG. 1 depicts a typical forced-air heating or cooling system using a hydronic loop and hydronic air-handler. A source of heating or cooling 101 such as, for example, a boiler or chiller, is connected to air-handler 102 via connecting lines 116 and 117. Air-hander 102 comprises a blower 103 and hydronic heat exchanger 104. Blower 103 pulls indoor air 114 from a building in which the system is located via an inlet air duct 105 and forces the air to flow over and/or through hydronic heat exchanger 104. The indoor air is either heated or cooled by heat exchanger 104 depending on whether the hydronic fluid flowing in lines 116 and 117 is hot or cold. Indoor air 115 exits air-handler and returns to the building via outlet air duct 106.

Located in the hydronic loop created by connecting lines 116 and 117 between the heating or cooling source 101 and the air-hander 102, is a pump 111 that circulates the hydronic fluid through the loop, air-bleed 107 that bleeds air out of the loop, filter 108 that captures particles or debris from the hydronic fluid, charging manifold 110, expansion tank 109, and water-glycol make-up device comprising at least tank 112 and pump 113. Charging manifold 110 comprises a valve 133 located so that when closed prevents flow through the hydronic loop, and valves 134 and 135 located upstream and downstream of valve 133. To charge the hydronic loop, an installer typically closes valve 133 and connects a charging assembly tool (not shown) to valves 134 and 135, whereby hydronic fluid is pumped from the charging tool into the hydronic loop through valve 134 and exits with air from the hydronic loop back into the charging assembly tool through valve 135. This process is continued until the air is pushed out of the hydronic loop, then valves 134 and 135 are closed and valve 133 is opened.

Figure 2:
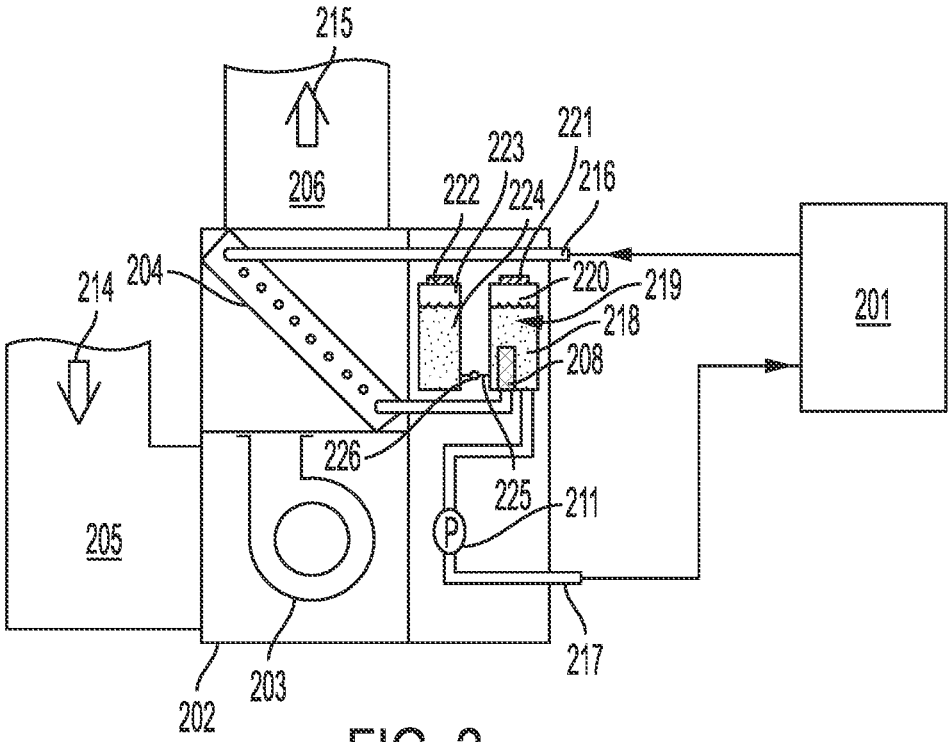
FIG. 2 schematically depicts a forced-air heating or cooling system using the hydronic AHU, including a blower, hydronic heat exchanger, pump, pressurized tank, non-pressurized tank, a tube or pipe providing a connection between the two tanks and a valve located in the tube or pipe connecting the two tanks.

FIG. 2 depicts a forced-air heating or cooling system using a hydronic AHU comprising a blower, hydronic heat exchanger, pump, pressurized tank, non-pressurized tank, a tube or pipe providing a connection between the two tanks and a valve located in the tube or pipe connecting the two tanks. A source of heating or cooling 201 such as a boiler or chiller, for example, is connected to air-handler 202 via connecting lines 216 and 217. Air-hander 202 comprises a blower 203 and hydronic heat exchanger 204. Blower 203 pulls indoor air 214 from the building via an inlet air duct 205 and forces the air to flow over and/or through hydronic heat exchanger 204. The indoor air is either heated or cooled by heat exchanger 204 depending on whether the hydronic fluid flowing in lines 216 and 217 is hot or cold. Indoor air 215 exits air-handler and returns to the building via outlet air duct 206. Although FIG. 2 shows the indoor air first entering blower 203 before flowing over or through heat exchanger 204, indoor air can optionally first pass over and/or through heat exchanger 204 before entering blower 203. Indoor air can flow either upward through the air-hander as shown or downward or horizontally.

Pump 211 pulls hydronic fluid out of pressurized tank 218, which contains a volume of hydronic fluid 219, trapped air volume 220, and removable lid 221. Hydronic fluid returns to pressurized tank 218 and through optional filter 208.

Non-pressurized tank 223, which contains hydronic fluid 224 and removable lid 222 is connected to pressurized tank 218 via connecting line 225. Valve 226 is located in connecting line 225 allows for fluid to flow from non-pressurized tank 223 to pressurized tank 218 when the pressure in pressurized tank falls below zero psig, but does not allow hydronic fluid to pass from the pressurized tank to the non-pressurized tank.

Figure 3:
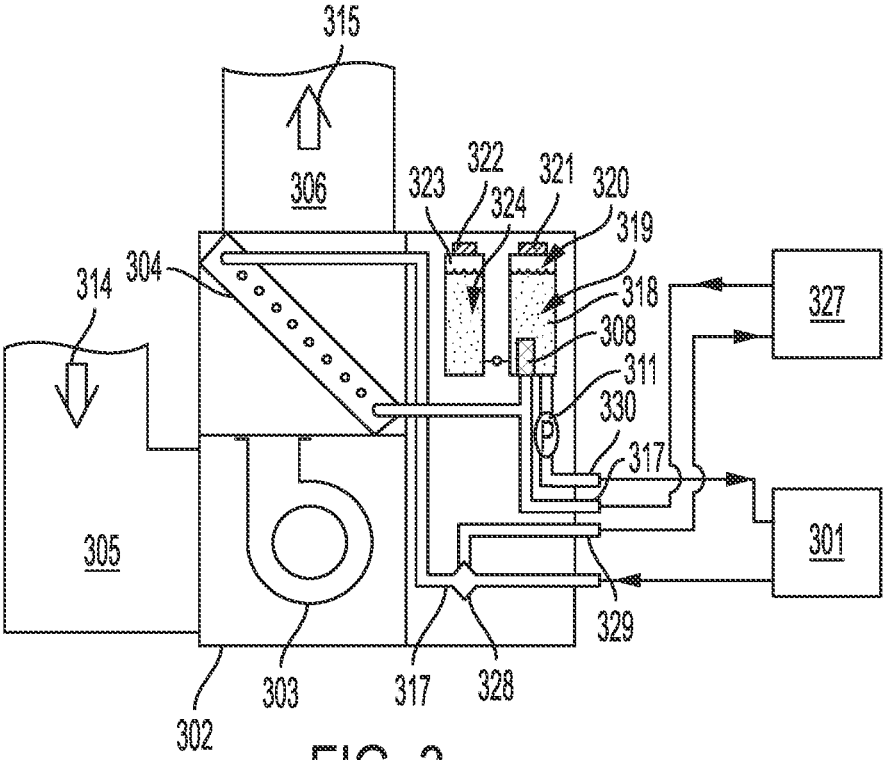
FIG. 3 schematically depicts the forced-air heating or cooling system depicted in FIG. 2, with the addition of a control valve that directs heated or cooled hydronic fluid to either the AHU heat exchanger or another heating or cooling device.

FIG. 3 depicts the forced-air heating or cooling system depicted in FIG. 2 (structure from FIG. 2 is shown in FIG. 3 with the same reference numbers except increased by 100), with the addition of control valve 328 that directs heated or cooled hydronic fluid from a hydronic heating or cooling source 301 to either the AHU heat exchanger 304 or another heating cooling device 327 such as an indirect storage tank for heating domestic hot water.

Figure 4:
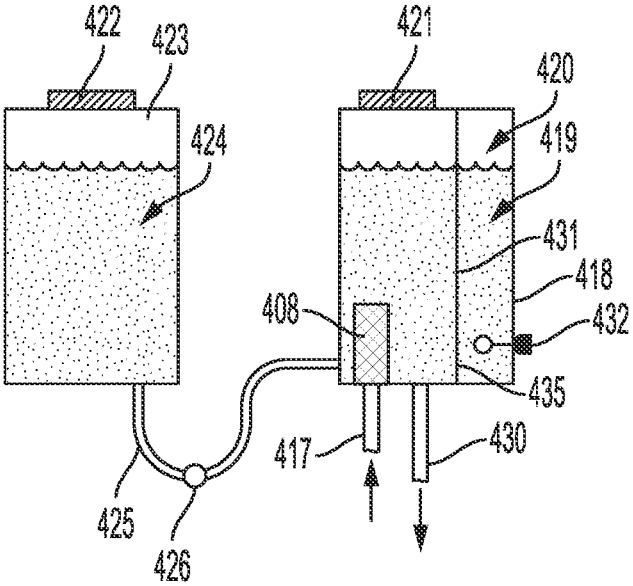
FIG. 4 schematically depicts a detailed view of the pressurized tank and non-pressurized tank.

FIG. 4 depicts a detailed view of the pressurized tank 418 and non-pressurized tank 423, the combination of which provides a method of filling the hydronic loop and bleeding air, automatic make-up of hydronic fluid to the hydronic loop, expansion volume for the hydronic fluid to manage the hydronic loop pressure and, optionally, filtering of the hydronic loop fluid, and monitoring of the hydronic fluid level.

The pressurized tank 418 includes a removable lid 421 that provides an opening to fill the tank with hydronic fluid 419, a trapped air volume 420 above the liquid level, and servicing the optional filter 408 and level sensor 432. When assembled to the tank, lid 421 provides a seal so that the tank can be pressurized without allowing hydronic fluid or air to escape. Optional divider panel 431 reduces the volume of hydronic fluid actively circulating though the hydronic loop, to thereby increase the speed at which the system can adjust to changes, and includes a small opening 435 to allow the liquid level in two portions of the tank to be the same level and pressure. Hydronic fluid is pulled out of the tank by the pump through connecting line 430, and returns to the tank via connecting line 417. Air-space 420 provides a volume for the hydronic fluid to expand into when the temperature of hydronic fluid 419 is increased, maintaining a safe hydronic loop pressure below 50 psig.

The non-pressurized tank 423 includes a removable lid 422 that provides an opening to fill the tank with hydronic fluid 424. Lid 422 does not tightly seal to the tank so that the tank is substantially at atmospheric pressure. The two tanks are connected using tube or pipe 425, which includes valve 426 that can be located at either end of tube or pipe 425, or anywhere in between. Valve 426 is configured so that hydronic fluid is allowed to flow from the non-pressurized tank 423 to pressurized tank 418 when the pressure in tank 418 falls below zero psig, which automatically provides make-up fluid to the hydronic loop when needed. Valve 426 also prevents flow from pressurized tank 418 to non-pressurized tank 423. This two tank configuration ensures the hydronic loop is full of liquid, prevents over-pressurization of the hydronic loop during heating cycles, and maintains the hydronic loop pressure in the pressurized tank no lower than about zero psig.

We thus provide a hydronic air-handler device intended to be connected to a heating or cooling source using a hydronic loop, for heating or cooling air. In addition to a blower that moves air and a hydronic heat exchanger for heating or cooling air, the hydronic air-handler device includes all of the components or functions necessary for a functional hydronic forced-air heating or cooling system except for the heating or cooling source. The components or functions include a hydronic pump, air bleed, expansion tank, method of quickly filling the hydronic loop with fluid and bleeding air, make-up hydronic fluid means, filter and fluid level sensing means. Integration of these components and functions into a single air-handler device allows for a lower installation cost a smaller operating footprint and improves operating efficiency.

The invention claimed is:

1. A hydronic air handler device that heats or cools air comprising:

a heat exchanger that contains a hot or cold hydronic fluid;

a blower that moves air over and/or through the heat exchanger;

a pump that circulates the hot or cold hydronic fluid;

a first vessel that contains a first hydronic fluid at greater than atmospheric pressure, air in a space above the first hydronic fluid, a first opening sealed by a removable lid, a second opening that allows the first hydronic fluid to exit the first vessel, a third opening that allows the first hydronic fluid to enter the first vessel, and a fourth opening;

a second vessel that contains a second hydronic fluid substantially at atmospheric pressure, a first opening sealed by a removable lid, and a second opening in communication with the first vessel via a first connecting line, wherein the second vessel is in communication with the fourth opening via a second connecting line;

wherein the first hydronic fluid and the second hydronic fluid may be the same or different; and a valve that allows the second hydronic fluid to flow from the second vessel to the first vessel when pressure inside the first vessel decreases below about zero psig, and prevents the first hydronic fluid from flowing from the first vessel to the second vessel.

2. The device of claim 1, wherein the blower is located below the heat exchanger and air moves upward or downward through the device.

3. The device of claim 1, wherein the blower is located above the heat exchanger and air moves upward or downward through the device.

4. The device of claim 1, wherein the blower is located adjacent to the heat exchanger and air moves horizontally through the device.

5. The device of claim 1, further comprising a control valve that directs the hot or cold hydronic fluid through the heat exchanger or to another heating or cooling device.

6. An air-handling unit (AHU) configured to be part of a forced-air heating or cooling system wherein a hydronic loop is used to transfer energy to or from a heating or cooling device to the AHU comprise:

a blower configured to move indoor air from the building space, across and/or through a hydronic heat exchanger, wherein the air is heated or cooled, and moved back to the building space;

a hydronic heat exchanger wherein heating or cooling is transferred from a hydronic loop to the indoor air passing over and/or through it, and the heat exchanger may be located either upstream or downstream of the blower;

a pump that moves the hydronic fluid through the hydronic loop, pulling hydronic fluid out of a pressurized tank;

a pressurized and sealed tank, at a pressure above atmospheric pressure, that contains a volume of hydronic fluid and a volume of air above the hydronic fluid to provide an expansion volume, an inlet opening that allows hydronic fluid to enter from the hydronic loop, an outlet opening that allows hydronic fluid to exit to the hydronic loop, a removable lid that allows the pressurized tank to be filled with hydronic fluid;

a non-pressurized tank that contains a volume of hydronic fluid and a removable lid that allows the non-pressurized tank to be filled with hydronic fluid;

a tube or pipe that connects the pressurized tank and the non-pressurized tank;

a valve located at the inlet, outlet or point in-between of the tube or pipe that connects the pressurized tank and non-pressurized tank configured so that if the pressure in the pressurized tank falls below about zero psig, the valve opens and allows hydronic fluid to flow from the non-pressurized tank to the pressurized tank until the pressure in the two tanks is equalized, wherein the valve is configured so that hydronic fluid cannot move from the pressurized tank to the non-pressurized tank.

7. The air-handling unit (AHU) configured to be part of a forced-air heating or cooling system according to claim 6, further comprising:

an optional filter that collects small debris present in the hydronic loop connected to either the hydronic inlet or outlet opening, and an optional sensor or switch that detects the amount of hydronic fluid inside the tank.

8. The air-handling unit (AHU) configured to be part of a forced-air heating or cooling system according to claim 6, further comprising:

a control valve that can be configured to direct the hot or cold hydronic fluid to either the AHU heat exchanger or another hydronic heating or cooling device such as an indirect storage tank for domestic hot water, conventional radiators or under-floor piping loops, or additional hydronic AHUs.

* * * * *